US008745829B2

(12) United States Patent
Wanzenboeck et al.

(10) Patent No.: US 8,745,829 B2
(45) Date of Patent: Jun. 10, 2014

(54) CLOSURE FOR CONNECTING STRAPS OF A GARMENT

(75) Inventors: Karl Wanzenboeck, Teesdorf (AT); Gerhard Fildan, Vienna (AT)

(73) Assignee: Fildan Accessories (HK) Ltd, Kwung Tong, Kowloon (HK)

( * ) Notice: Subject to any disclaimer, the term of this patent is extended or adjusted under 35 U.S.C. 154(b) by 74 days.

(21) Appl. No.: 13/280,901

(22) Filed: Oct. 25, 2011

(65) Prior Publication Data

US 2012/0102686 A1 May 3, 2012

(30) Foreign Application Priority Data

Oct. 28, 2010 (DE) ..... 10 2010 049 678

(51) Int. Cl.
*A41C 3/00* (2006.01)

(52) U.S. Cl.
USPC ..... 24/591.1; 24/465; 24/444; 24/578.1; 24/578.14; 24/588.12; 2/338; 450/63; 450/26

(58) Field of Classification Search
CPC ..... A41F 1/006; A41C 3/02; A41C 3/12; A44B 18/0069; A61F 13/5622
USPC ..... 24/465, 444, 448, 466, 578.12, 591.1, 24/666, 667, 698.1, 695, 578.14, 578.1, 24/588.12; 2/338; 450/63, 14, 9, 13, 17, 450/18, 26, 28, 71–73, 82, 58
See application file for complete search history.

(56) References Cited

U.S. PATENT DOCUMENTS

| | | | | |
|---|---|---|---|---|
| 4,183,121 | A * | 1/1980 | Cousins | 24/588.1 |
| 4,606,079 | A * | 8/1986 | DeWoskin | 2/338 |
| 4,633,565 | A * | 1/1987 | DeWoskin | 29/417 |
| 7,722,433 | B2 * | 5/2010 | Utaka | 450/79 |
| 2006/0094336 | A1 * | 5/2006 | Fildan et al. | 450/92 |
| 2010/0101058 | A1 | 4/2010 | Fildan | |

* cited by examiner

*Primary Examiner* — Robert J Sandy
*Assistant Examiner* — Michael Lee
(74) *Attorney, Agent, or Firm* — Andrew Wilford

(57) ABSTRACT

In the case of a closure for connecting two straps of an item of clothing, in particular the wing end portions of the back band of a bra, on one of which is arranged an overall female closure part, there is provided a plurality of female closure elements that form at least one row, and on the other of which is arranged an overall male closure part, which includes at least two male closure elements that can be moved into force-fitting/form-fitting engagement with female closure elements from one row of the female closure part. The closure elements are arranged in each case on a preferably textile base strip, which is rectangular in basic form, acts as a carrier and serves for fastening the respective closure parts on their associated band wing ends, which overlap in their end regions in the closed configuration.

5 Claims, 3 Drawing Sheets

CLOSURE FOR CONNECTING STRAPS OF A GARMENT

FIELD OF THE INVENTION

The present invention relates to a closure for connecting straps of a garment. More particularly this invention concerns a fastener for a brassiere.

BACKGROUND OF THE INVENTION

A closure can connect two straps of an item of clothing, in particular the wing end portions of the back band of a bra, on one of which is arranged an overall female closure part that includes a plurality of female closure elements arranged in rows, and on the other of which is arranged an overall male closure part that includes at least two male closure elements that can be moved into force-fitting/form-fitting engagement with female closure elements from one row of the female closure part. In this case the closure elements are arranged in each case on a textile base strip, which in basic form is rectangular, acts as a carrier and serves for fastening the respective closure elements on their associated band wing ends, which overlap in their end regions in the closed configuration.

These types of closures are known, for example, by WO 2010/046488 (US 2010/0101058).

In the case of the known closures, the male and female closure elements are realized as plastics material parts that, in each case, are arranged on the one side of their associated textile material web, which forms the contact layer of the back band of the bra arranged on the body of the wearer, and are held on the textile web by way of counter pieces that are arranged on the respective oppositely situated side of the associated textile web, wherein the closure elements are welded together with the counter pieces, which have points that penetrate through the material web, wherein the points form bridges between the parts that are welded together, the bridges passing through the textile webs. One type of manufacture of the female and male closure elements that is also possible and provided is in such a manner that they are produced in a single injection molding operation on the textile webs that support them, i.e. they are not welded on next to each other, but are produced, as it were, right from the beginning as an integral part.

In the case of these types of closures that are intended for corsetry, as a rule it is desirable to develop the closure region, in which, for example, the wing ends of the back band of a bra abut against each other, in as unobtrusive a manner as possible. It is currently not possible to use the same textile fabric that also forms the visible side of the respective back band for the textile covering of the closure elements, as for this purpose edge regions of the band supporting the closure elements are folded around the back band of the bra and are sewn to the back band. This method of operation, which implies numerous operations, is awkward and also results in the closure having a relatively large thickness in the overlap region of the male and female closure parts, which also disturbs the overall visual impression. This applies at least when the bra is worn so as to be visible, as is the case, for example, with a swimsuit. But also whenever the bra is worn as an undergarment, i.e. underneath an item of outer clothing, the increased thickness in the closure region on the visible side of the item of outer clothing can cause bulges that impair the visual impression.

OBJECTS OF THE INVENTION

It is therefore an object of the present invention to provide an improved closure for connecting straps of a garment.

Another object is the provision of such an improved closure for connecting straps of a garment that overcomes the above-given disadvantages, in particular that can be produced in an efficient and correspondingly inexpensive manner and can be adapted simply to the outer development of the respective corsetry.

SUMMARY OF THE INVENTION

This object is achieved according to the invention by a closure wherein the base strips supporting the closure elements are realized in at least two layers with, when viewed in the closed configuration of the closure, one "inner" contact layer, which faces the body of the wearer and abuts against the body, and one "outer" cover layer, which faces away from the body of the wearer, it being possible for the materials from which the contact layer and the cover layer are produced to be elastic, and both the contact layer and the cover layer are applied onto a specifically associated connecting layer and are fixed on the connecting layer at points in a narrow grid or over the surface, wherein the connecting layers are fixedly welded together by means of ultrasound welding at least in the central region between the cover and the contact layer.

On account of the replacement of sewing operations by ultrasound welding operations, which can be accomplished in a fraction of the time required for the sewing operations, this design of the closure according to the invention makes an efficient, high-quality type of production possible along with diverse design possibilities for the cover and contact surfaces, that, thanks to the weldable connecting layers, can be implemented by material layers of practically arbitrary texture.

If the connecting layers are realized as woven fabric or knitted fabric of polyamide or polyester fibre material, it is expedient to take into consideration the surface-related weight relationships for the cover and contact layers in relation to the connecting layers, which are to be understood in terms of a best possible compromise between strength and wearing comfort.

BRIEF DESCRIPTION OF THE DRAWING

The above and other objects, features, and advantages will become more readily apparent from the following description, reference being made to the accompanying drawing in which.

DETAILED DESCRIPTION

Figure 1A:
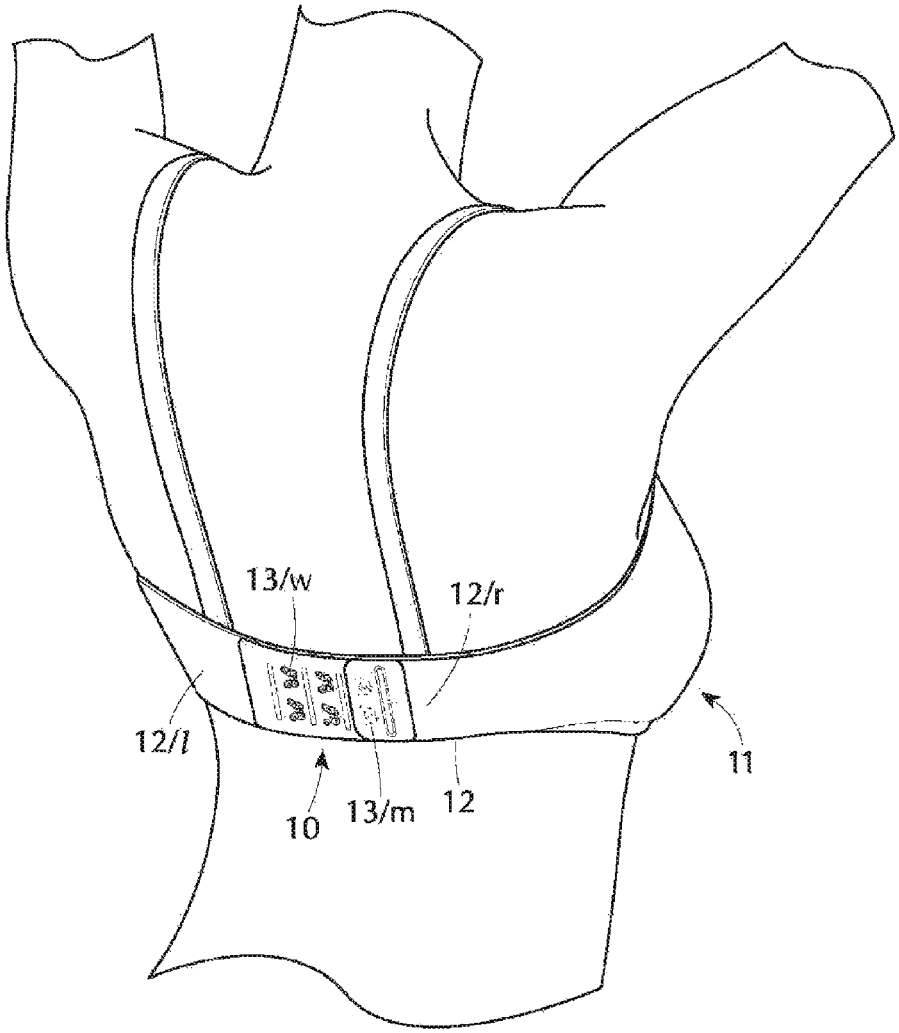
FIG. 1A shows a schematically simplified representation of a closure according to the invention used on a strap bra as a back closure, in the in-use configuration of the bra.

As seen in FIG. 1A, a closure for the detachably inextensible connection of two straps of an item of clothing is given the overall reference 10, the item of clothing being shown in the form of a typical strap bra 11 that is intended as an undergarment, but can also be used as an upper part of a swimsuit or of an item of sports clothing.

In the case of the illustrated embodiment selected for explanation, the closure 10 is used as a back closure, by means of which, in the representation in FIG. 1A, the left-hand end portion 12/l and the right-hand end portion 12/r of the back band, given the overall reference 12, of the bra 11 can be connected together so as to be detachable in an inextensible and at the same time comfortable manner.

The closure 10 includes a female closure part 13/w, given the overall reference 13/w, and a male closure part, given the overall reference 13/m, the mutual engagement of which closure parts bringing about the inextensible connection between the two back wing end portions 12/l and 12/r of the back band 12 of the bra 11.

In the case of the illustrated embodiment selected for explanation, the female closure part 13/w, as can be seen in the representation in FIG. 1A, is arranged on the, (according to the representation), left-hand end portion 12/l of the back band 12 and, accordingly, the male closure part 13/m is arranged on the right-hand end portion 12/r of the back band 12.

Corresponding to the genus of the closure parts 13/w and 13/m, the female closure part 13/w includes a plurality of female closure elements 14 that are arranged in rows at regular spacings, wherein up to four closure elements can be arranged in one row, which extends in each case transversely with respect to the development of the back band 12 that follows the outline of the body.

In contrast to this, the male closure part 13/m, which is arranged on the other back band wing 12/r, only includes one row of male closure elements 15, which are, accordingly, also only able to be moved into engagement with the female closure elements 14 of one row of the female closure part 13/w, wherein by selecting the row of female closure elements with which the male closure elements of the male closure part are moved into engagement, the bra is adapted to the outline of the body of its wearer.

The female closure part 13/w, in the case of the particular illustrated embodiment selected for explanation, is includes six female closure elements 14, which are arranged on a base strip 16/l, which has a elongated rectangular basic shape, is realized as a carrier for the female closure elements and serves for fastening the closure piece on the associated end portion 12/l of the back band of the bra 11.

In an analogous manner, the male closure part 13/m, which, in the case of the illustrated embodiment selected for explanation, includes only two male closure elements 15, is arranged on a base strip 16/r and is fastened on the associated end portion 12/r of the back band 12 of the bra 11.

In a typical development of the bra 11 and a design of the closure 10 adapted hereto, the base strip 16/l of the female closure part 13/w has a length 1 of approximately 6 cm and a width b of approximately 3 cm that, in the case of the illustrated embodiment represented for explanation, corresponds to the width of that wing of the back band 12 on which the female closure part 13/m is fastened. The base strip, which supports the male closure part, is shorter corresponding to the lower number of closure elements 15.

The female closure elements 14 are arranged in three equidistant rows, which in each case include two closure elements 14, symmetrically with reference to the longitudinal central plane 17 of the base strip 16, which, in the closed configuration of the closure 10, is also its longitudinal central plane 17.

The base strip 16/l used for fastening the female closure part 13/w consists of a total of four material layers that is/are connected in a positively bonded manner to the textile material layer/layers that is/are adjacent in each case.

The base strip 16/l of the female closure part 13/w consists of two part strips 16/a and 16/t, one of which, namely the "inner" part strip 16/t, when viewed in the in-use position of the bra 11, abuts against the body of the wearer and on its outer side, facing away from the wearer, is connected to the side of the outer part strip 16/a facing it, the outer part strip being connected on the outer side of the base strip 16 facing away from the wearer or on the outside of the associated wing end portion 12/l to the base strip.

The two part strips 16/a and 16/t, in their turn, are realized with two layers. They have in each case one supporting material layer 16/av or 16/tv, which is fusible by means of the effect of ultrasound and is thereby suitable for a welding connection, and one material layer, which is supported by the respective connecting layer and is applied onto the respective supporting material layer in a bonding or laminating process; the "supporting" connecting layers consist of a material that is flexible in the sense of bendable, but in practice is not extensible, such that the applied material, which can be realized as only slightly wear-resistant thin silk or lace, is not exposed to any stretching or extending loads and consequently can readily be used for the aesthetic development of the respective item of underwear, which is naturally significant in particular for the outer part strip 16/a.

In the case of the part strip 16/t that faces the wearer, the two-layered structure is utilized to optimize wearing comfort, e.g. by attaching a brushed cotton material on the inelastic connecting layer 16/tv, which acts as an elastic cushion and/or is compressed in regions e.g. by a linear narrow welding region, such that air flow channels are created on the body side that contribute, for example, to a cooling effect and bring about a pleasant wearing feeling.

The two part strips 16/t and 16/a of the base strip 16 of the female closure part 13/w are not welded with the associated end portion 12/l of the back band 12, such that the end portions of the part strips can abut against oppositely situated end portion regions of the back band and are connectable to the back band in a load-resistant manner, e.g. by means of sewing.

Figure 2:
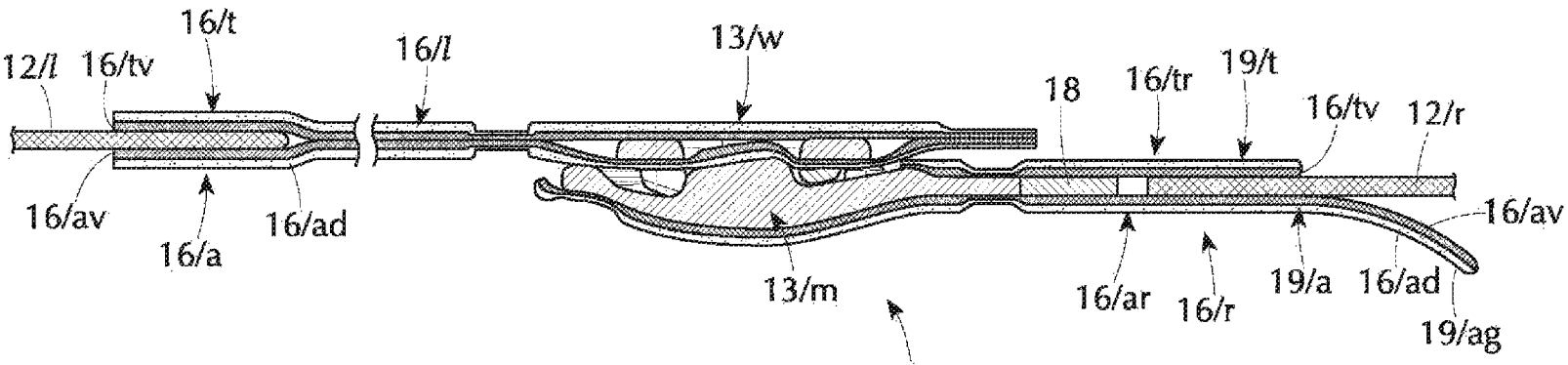
FIG. 2 shows a section longitudinally of the plane II-II in FIG. 1B, when viewed in the closed configuration of the closure in FIG. 1B.

In a manner analogous to this, as can be seen directly in FIG. 2, the male closure part 13/m, in the case of the particular back closure 10 selected for explanation, is connected to the, according to FIG. 1A, right-hand end portion 12/r of the associated back band wing, wherein the part strips 16/tr and 16/ar, which are analogous to the part strips 16/a and 16/t of the female closure part 13/w, are welded onto a flat bar-shaped end portion 18 of the male closure part 13/m by way of their connecting layers 16/av or 16/tv. These connecting layers, in their turn, are once again provided with free tab regions 19/a and 19/t, which are not welded together and are inextensibly connectable in a suitable manner, e.g. by being sewn on, to the right-hand end portion 12/r of the back band 12 of the bra 10 arranged in between the tab regions.

In addition, there is provided a free end portion 19/ag of the outer tab region that, in its turn, is not connected to the right-hand end portion 12/r of the back band 12 and consequently can be utilized as a grip, by way of which the male closure part 13/m is able to be pulled into its anchoring position.

In the case of the male closure part 13/m, the outer part strip 16/a of its base strip 16/r is welded with its connecting layer 16/av directly onto the flatly curved region is supporting the male closure parts 15 and onto the connecting flat bar-shaped end portion 18 of the closure part 13/m.

The closure 10 according to the invention with the multi-layered design, the basic features of which have been explained above by way of a particular illustrated embodiment, is modifiable in diverse ways, e.g. by the choice of materials for the cover layer and the contact layer, the way in which color is used and/or with regard to the strength or the texture of the material and is adaptable to the requirements and the taste of the wearers of the corsetry provided with the closure.

It is expedient to the welding work when the connecting layers consist of polyamide or polyester material. The cover layers and the contact layers of the part strips 16/a and 16/t can be realized as woven or knitted textile materials that can be produced from natural fibers or plastics material fibers, in particular also microfibers, wherein the part strips of such materials can be cut to length from prefabricated bands that are able to be obtained in an inexpensive manner as fabricated materials.

Where flat closure elements are used, such as is known in particular from the already quoted WO 2010/046488 A1, the closure 10 is able to be constructed in a flat manner overall, which is altogether of benefit to the aesthetically pleasing development of an item of clothing provided with the closure.

In view of this, to complete the picture, the basic design of the closure elements 14 and 15 of the female closure part 13/w and of the male closure part 13/m is as follows:

The male closure elements 15 each have a narrow guide strip 15/f, which is connected to the flat bar-shaped end portion 18 of the male closure part 13/m and on the "free" end of which is arranged an anchoring head 15/k, which is developed so as to be flatly curved in the shape of an almond or in the shape of a discus in such a manner that its diameter is significantly greater than the width or thickness of the guide strip 15/f of the respective male closure element 15.

Figure 1B:
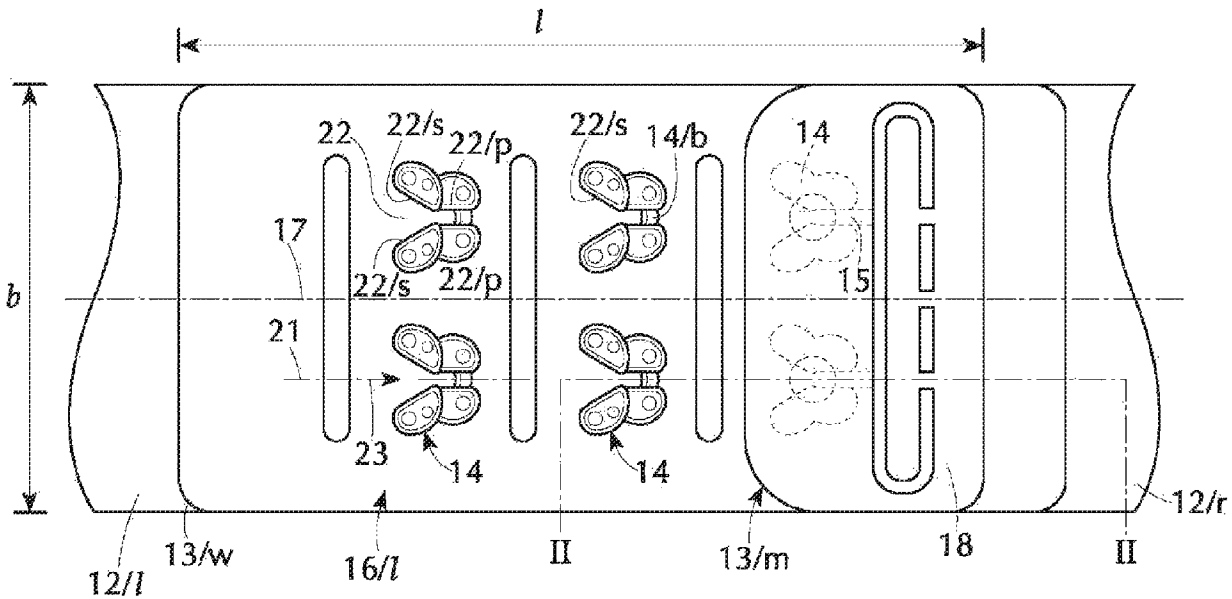
FIG. 1B shows an enlarged representation of the closure of the bra in FIG. 1*a*.
Figure 1C:
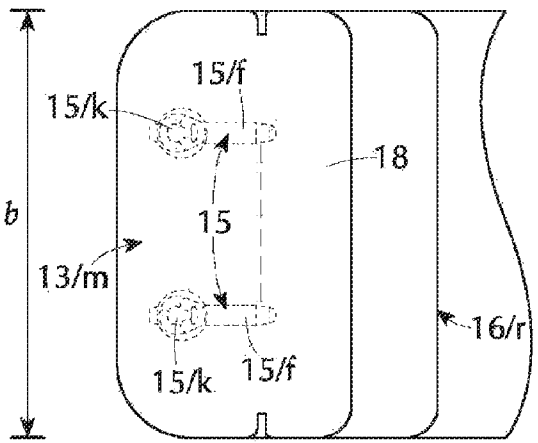
FIG. 1C shows a male closure part of the closure as in FIGS. 1A and 1B, in a view from the side thereof that faces the female closure part

The female closure elements 14, which, when viewed in the top view representation in FIG. 1B, have a shape similar to a butterfly and are fastened with the aid of counter pieces on the respectively used back band portion, are realized in a symmetrical manner with reference to their longitudinal central plane that extends at a right angle to the respective band portion and define insert slots 22, into which the male closure elements 15 can be inserted in a guided manner in the insertion direction that is represented by the arrow 23. The guiding in this direction is formed by parallel portions 22/p of the insert slots 22, between which the respective male closure element with its guide strip 15/f is guided so as to be displaceable.

Connecting to the parallel guide slot portions 22/p, extending at an acute angle with respect to the central plane 21, are edge portions 22/s of the insertion slots 22, which, in the course of the insertion of the respective male closure element, engage more and more over edge regions of the anchoring head 15/k that are located opposite each other, as a result of which the closure elements 13/w and 13/m are pressed against each other with increasing force when the male closure element 14 is pushed into the female closure part 14 in the direction of the arrow 23. The closed configuration of the closure 14 is obtained, on the one hand, by a latching action between the male and female closure elements 15 and 14 and, on the other hand, by a stop action of the respective anchoring head 15/k with a bridge element 14/b of the respective female closure element 14.

Latching elements, which prevent the closure elements jerking out of their engagement position even when no tensile stress is present in the back band 12 of the bra 11, are not represented specifically for the purposes of simplification.

In summary, the following is to be emphasized: In the case of a closure 10 for connecting two straps of an item of clothing, in particular the wing end portions 12/l, 12/r of the back band 12 of a bra 11, on one of which is arranged an overall female closure part 13/w, there is provided a plurality of female closure elements 14 that form at least one row, and on the other of which is arranged an overall male closure part 13/m, which includes at least two male closure elements 15, which can be moved into force-fitting/form-fitting engagement with female closure elements from one row of the female closure part. The closure elements 14 or 15 are arranged in each case on a preferably textile base strip 16/l or 16/r, which is rectangular in basic form, acts as a carrier and serves for fastening the respective closure parts 13/w, 13/m on their associated band wing ends 12/l or 12/r, which overlap in their end regions in the closed configuration. The base strips 16 are realized in multiple layers, with, when viewed in the closed configuration of the closure, one "inner" contact layer 16/tv, which faces the body of the wearer and abuts against the body, and one "outer" cover layer 16/ad, which faces away from the body of the wearer, it being possible for the materials of the layers to be elastically extensible. The contact layer and the cover layer are each applied onto a connecting layer 16/av and are fixed on the connecting layer at points in a narrow grid or over the surface. The connecting layers 16/av are fixedly connected together by means of ultrasound welding at least in the central region between the cover and the contact layer

We claim:

1. A closure for connecting two straps of a garment worn against a wearer's body, the closure comprising:

respective generally rectangular inner and outer base strips on each of the two straps, each strip including an elastic inner contact layer between the respective strap and the wearer and having an outer face turned away from the wearer, a flexible and inelastic inner connecting layer on the outer face of the inner contact layer and bonding the inner contact layer to the respective strap, an elastic outer cover layer having an inner face turned toward the wearer, and a flexible and inelastic outer connecting layer on the inner face of the outer cover layer and bonding the outer cover layer to the respective strap, whereby the straps are sandwiched between the respective inner contact layer and the respective outer cover layer and the base strips each have an end region extending past the respective straps, the connecting layers of the inner base strip being bonded together at the respective end regions;

at least two female closure elements carried on an outer face of the end region of the inner base strip; and at least one male closure element carried on an inner face of the end region of the outer base strip and fittable with either of the female closure elements.

2. The closure according to claim 1, wherein the connecting layers are woven fabric or knitted fabric of polyamide or polyester.

3. The closure according to claim 1, wherein the weight per unit area of the layer structure comprising the outer cover layer, the connecting layers and the contact layer is between 400 g/m$^2$ and 800 g/m$^2$.

4. The closure according to claim 3, wherein the contact layer and the cover layer each have a weight per unit area of between 120 g/m$^2$ and 240 g/m$^2$.

5. The closure according to claim 1, wherein, on its outer face turned away from the wearer, the male closure part is welded to and covered completely by the respective base strip.

* * * * *